United States Patent [19]

Schurman

[11] 4,369,575

[45] Jan. 25, 1983

[54] TOTE DEVICE

[75] Inventor: Peter T. Schurman, Woodbridge, Conn.

[73] Assignee: The Plastic Forming Company, Inc., Woodbridge, Conn.

[21] Appl. No.: 230,304

[22] Filed: Jan. 30, 1981

[51] Int. Cl.[3] ..... B65D 85/00

[52] U.S. Cl. ..... 30/151; 206/349; 294/165; 312/244

[58] Field of Search ..... 30/296 A, 143, 151, 30/382; 312/244, 283, 285; 220/69; 294/167, 145, 165, 137; 206/319, 349

[56] References Cited

U.S. PATENT DOCUMENTS

| | | | |
|---|---|---|---|
| 3,344,818 | 10/1967 | Musgrove | 30/151 |
| 3,858,954 | 1/1975 | Hetterich | 312/244 |
| 3,861,556 | 1/1975 | Barecki | 312/244 X |
| 3,933,243 | 1/1976 | Schurman | 206/319 X |
| 4,037,549 | 7/1977 | Hanyu | 312/244 X |
| 4,162,004 | 7/1979 | Thomas | 206/349 |

*Primary Examiner*—Jimmy C. Peters

*Attorney, Agent, or Firm*—St. Onge, Steward, Johnston & Reens

[57] ABSTRACT

A tote device for an article, such as a chainsaw, having a main body and a member projecting from one side of the body, comprises a base for supporting the body when at rest. The base is formed with an upwardly open recess configured to receive at least a portion of the body. A scabbard is mountable on the member to enclose and protect at least a portion of it. A first linking arrangement links the scabbard, when mounted on the member, to the base in the region of the one side of the body and a second linking arrangement links the base to the body, when received in the recess, at a location remote from the one side. Accordingly, when the body and member are lifted, the scabbard is also lifted. Further, interaction of the scabbard and body with the base, through the first and second linking arrangements, also lifts the base.

14 Claims, 13 Drawing Figures

12
14
28
24
22
20
32
42
21
16
18
10
80
62
60
31
30
54
59

TOTE DEVICE

BACKGROUND OF THE INVENTION

1. Field of the Invention

The present invention relates to a tote device for an article that includes a main body and a member projecting from one side of the body. The tote device of the invention may be used with particular advantage for carying a tool such as a chain saw that includes a main housing, a power supplying motor or engine mounted in the housing, a blade projecting laterally from one side of the housing, a chain carrying saw teeth guided about at least a portion of the periphery of the blade and driven by the motor or engine, and a handle for manipulating the saw projecting laterally from a side of the housing different from the one side.

It is desirable to provide protection for both the blade and the chain of a chain saw since these components are subject to damage. These components should also be shielded to minimize the chance of injury to the operator or others during storage and transport of the saw. It is further desirable to provide means for conveniently carring tools and extra lubricant with the saw when it is taken to a job site.

The tote device of the present invention may also be used advantageously with tools and articles other than chain saws that nevertheless have at least one projecting member that should be enclosed and protected and that have accessories which are desirably carried with the tool to a job or other site.

2. Description of the Prior Art

Various devices for carrying tools such as chain saws are known. The most common of such devices is a conventional case that completely encloses all of the components of the tool. Such cases typically include a base and cover hinged to the base that may be of double-walled blow molded construction. If the tool to be carried is a chain saw, the base is usually molded with a recess specifically formed to receive portions of the blade, housing, and handles of the saw. The cover may also be formed with a recess specifically formed to receive portions of the saw opposite those to be received in the base. The cover typically may be pivoted on its hinges between open and closed positions relative to the base which respectively provide access to the saw and enclose and shield it.

Such tool cases may also include containers for storing oil or other lubricants and compartments for storing accessories such as tools for adjusting components of the saw.

Known prior art cases of the type described above have distinct disadvantages. Because they entirely enclose the tool which may be large, they too must necessarily be large and therefore require substantial amounts of material to make. Yet it is especially desirable to conserve materials, particularly thermo-plastic and thermo-setting resins used to make such cases with blow molding techniques, for economic and other reasons. Because of the size of the components of such cases, when they are made with blow molding techniques they require substantial amounts of time for formation of each component. Therefore, the manufacturing process is relatively slow. Further because the base and cover of such cases are large and therefore bulky, they require substantial space for storage and transportation.

SUMMARY OF THE INVENTION

It is an object of the present invention to provide a tote device for a tool like a chain saw that minimizes or eliminates many of the drawbacks which characterize prior art cases for such tools of the type described above.

More particularly, it is an object of the present invention to provide a tote device for tools such as chain saws that requires substantially less material to manufacture than do prior art cases.

It is another object of the present invention to provide such a tote device which may be manufactured in substantially less time than known cases.

It is a further object of the present invention to provide a tote device that may be nested or stacked for storage and shipment in such a manner that substantial space is conserved.

It is yet a further object of the present invention to provide a tote device which provides protection for a projecting member such as the blade which guides a tooth carrying chain of a chain saw and to shield that projecting member to minimize the chances of injury that might result should the member be exposed.

It is still another object of the present invention to provide such a tote device that includes means for storing excessories and lubricants for the tool and transporting them with the tool to a job or other site.

Another object of the present invention to provide such a tote device which is easily and conveniently used.

In general accordance with the present invention, a tote device for a tool such as a chain saw described above includes a base for supporting the housing of the saw when at rest that is formed with an upwardly open recess configured to receive at least a portion of the housing and the handle. A scabbard is mountable on the blade of the saw to enclose and protect at least a portion of the blade, the chain, and the saw teeth carried on the chain. A first linking arrangement links the scabbard, when mounted on the blade, to the base in the region on the side of the housing from which the blade projects. A second linking arrangement links the base to the handle when the housing is received in the recess formed in the base.

Accordingly, the blade supports the scabbard when mounted thereon. Further, the base is supported by the scabbard and the handle, through the first and second linking arrangements, when the chain saw is lifted and carried. It will be appreciated then that the tote device in accordance with the invention fully encloses only a portion of the chain saw, namely the blade and tooth carrying chain, which is most important to shield. Therefore, the parts of this tote device are much smaller than large cases known in the art that completely enclose a tool and substantial saving of material in manufacture is accordingly realized. Because the parts of the tote device of the invention are smaller, they may be easily made with conventional blow molding techniques with relatively short molding cycle times. Accordingly, substantial savings in fabrication of the device are realized.

Further, the base and scabbard are designed to have relatively low or generally flat profiles and to be nestable or generally stackable for shipment and storage. Again, then, savings in shipment and storage costs are realized.

The base of the tote device in general accordance with the invention also forms a drip pan for lubricants from the engine or motor of tools like chain saws and has a compartment for storing accessories for the saw.

While the entire saw is not enclosed to seal it against dust and moisture infiltration, and the most important components of the saw, that is, the most vulnerable to such elements, namely the blade and chain, are substantially covered.

Thus, substantial improvements over prior art devices for carrying tools such as chain saws are realized.

Other objects, aspects, and features of the present invention will be pointed out in and understood from the following detailed description provided below in conjunction with the accompanying drawings.

DETAILED DESCRIPTION OF THE PREFERRED EMBODIMENTS

Figure 1:
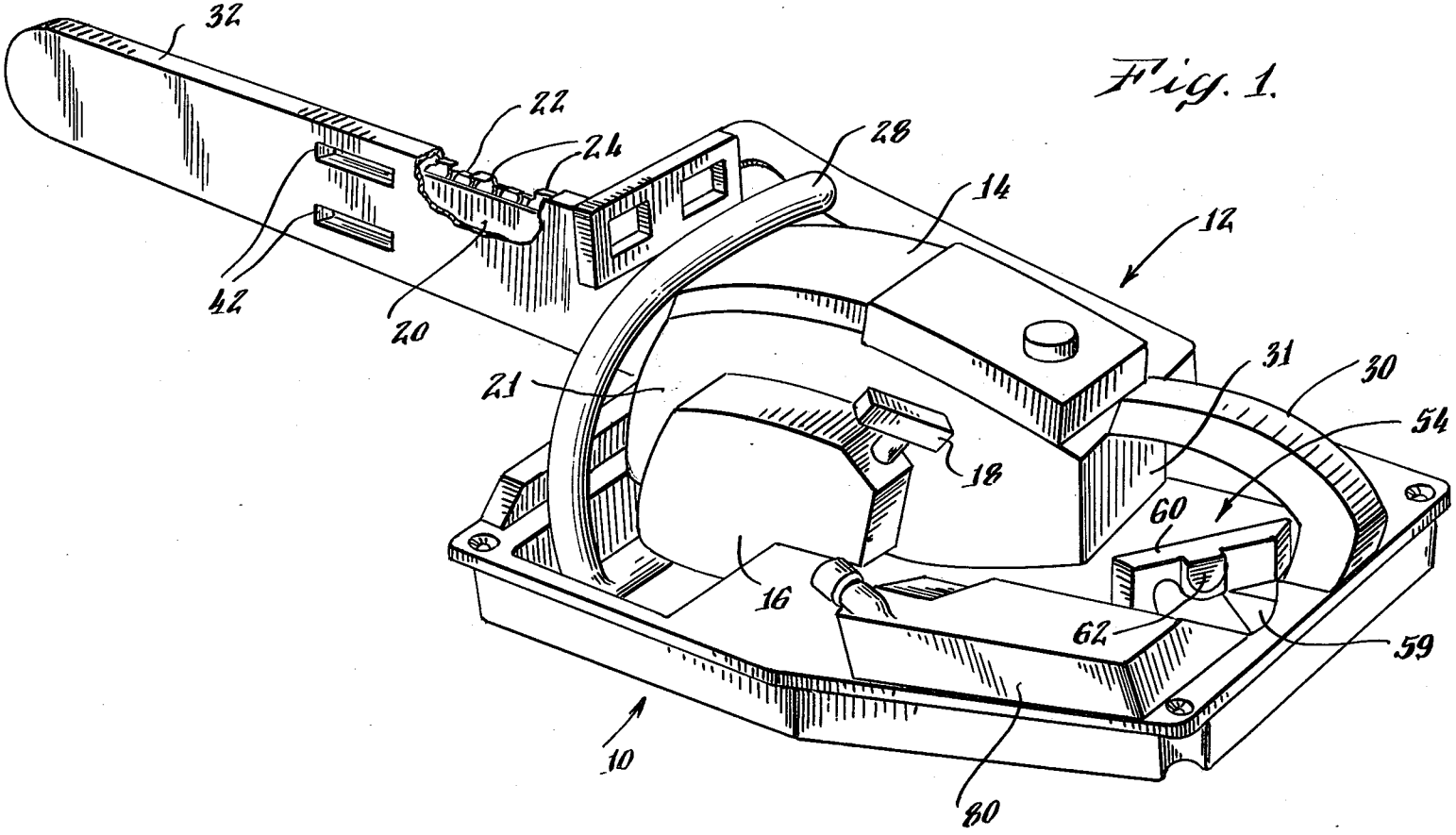
FIG. 1 is a perspective view of the tote device in accordance with the present invention shown with a chain saw resting therein.

Referring first to FIG. 1, the tote device of the present invention, generally indicated at 10, is used in conjunction with a tool such as a chain saw 12 of generally conventional construction. Of course, the tote device of the present invention may be adapted for chain saws of various configurations and dimensions without departing from the concept of the present invention. Further, this tote device may be used with tools or articles other than chain saws which have a main body and a member projecting from one side of that body. However, for convenience of description the present invention will be described with reference to the illustrated chain saw 12.

As shown in FIG. 1, the chain saw includes a main housing 14 which encloses a motor or engine (not shown). The chain saw illustrated in FIG. 1 is powered by gasoline and accordingly includes a recoil starter 16 having a T-shaped handle 18 attached to a pull-cord (not shown). The chain saw further includes a blade 20 projecting laterally or sidewardly from one side 21 of the housing and which guides a chain 22 about its periphery. The chain carries a plurality of saw teeth 24 and is driven by the motor mounted in the housing 14.

The chain saw 12 further includes two handles 26 and 28 secured to the housing at a forward portion thereof and a rear handle 30 which projects laterally from a side 31 of the housing opposite to that from which the blade projects. The forward handles 26 and 28 are mounted near the center of gravity of the saw so that it may be easily balanced by an operator when used. The rear handle usually includes a trigger or throttle mechanism (not shown) for varying the speed with which the engine drives the chain. Further, the rear handle is used to manipulate the saw while balanced with the front handles during operation.

The tote device in accordance with the preferred embodiment of the present invention includes a hollow scabbard 32 which encloses substantially all of the blade and substantially all of the chain and saw teeth exposed on the blade that are not hidden within the housing. The tote device further includes a separate base 34 which supports the housing of the chain saw when it is at rest.

Referring now more particularly to FIGS. 2, 3, 6 and 7, the scabbard 32 is elongate and shaped to be slidingly received over the blade and chain of the chain saw. More particularly, it includes mutually parallel side walls 36 and 37, a top wall 38 and a bottom wall 40 parallel to the top wall. The scabbard is further formed with inwardly projecting ribs, two of which 42 are positioned one above the other and project inwardly from one side wall 36 and two others of which 44 are substantially colinear and project from the other of the side walls 37. These ribs stiffen the scabbard and provide a snug fit of it on the blade.

At its rear end 46 and projecting backwardly from and to one side of the bottom wall 40, the scabbard is formed with a hook 48 that has a forwardly open notch 50. The hook further defines a generally upwardly facing support surface 52, the function of which will be described in greater detail below.

Figure 2:
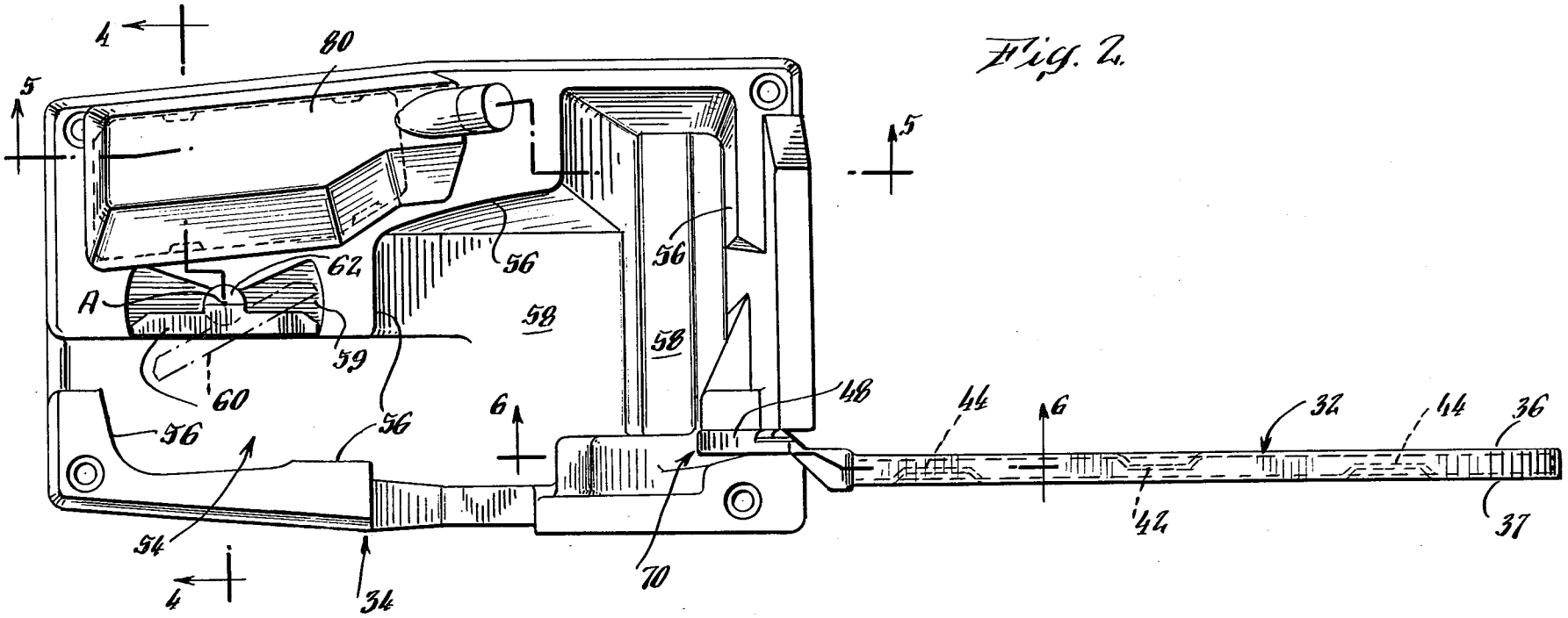
FIG. 2 is a top plan view of the tote device shown in FIG. 1 with the chain saw removed.
Figure 3:
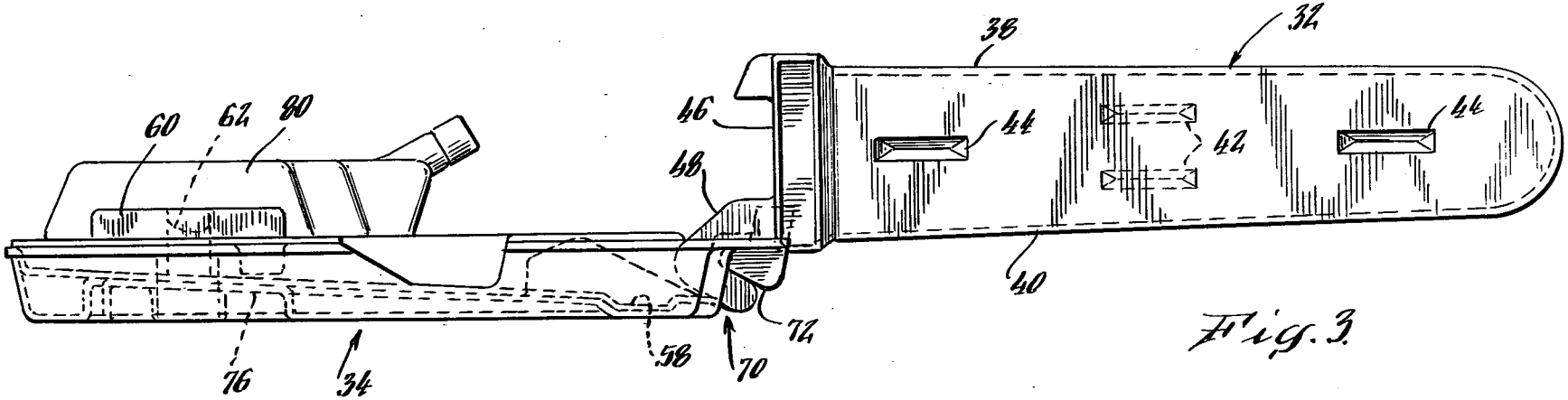
FIG. 3 is a side elevational view of the tote device as shown in FIG. 2.

The base which is shown in greater detail in FIGS. 2 and 3, is formed with an upwardly open recess 54 that is configured to receive a portion of the chain saw housing, namely the bottom of this housing. As can be seen from the figures, the base is formed with a member of upstanding walls 56 contoured to the peripheral shape of the bottom of the housing of the chain saw and these walls, together with an inner bottom wall 58 of the base define the recess 54.

Figure 4:
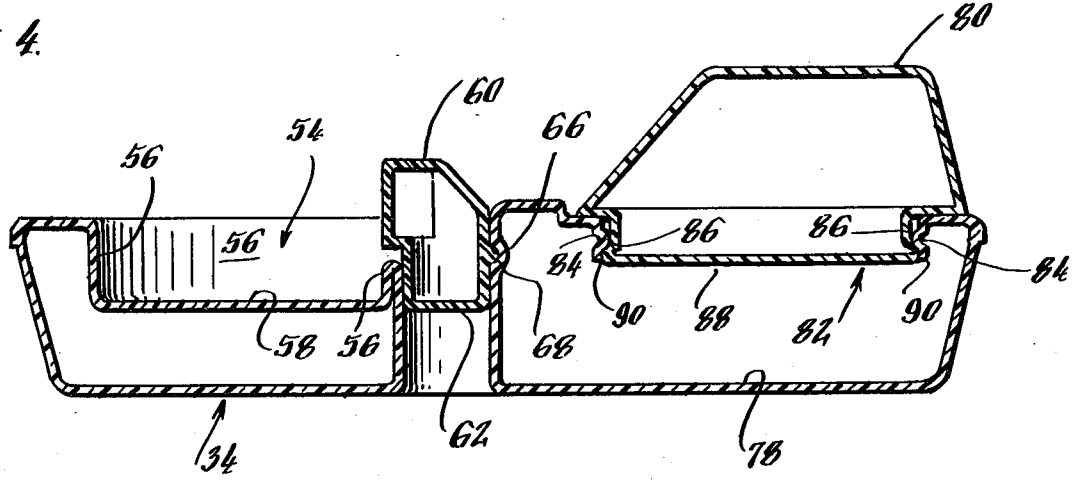
FIG. 4 is a vertical cross-sectional view of portions of the base of the tote device taken through discontinuous plane 4—4 in FIG. 2.

As shown in FIGS. 1, 2 and 4, a latch 59 is mounted in the central rearward region of the base for pivoted movement about a vertical axis A therein. More particularly, the latch includes a pair of sidewardly projecting arms 60 and a downwardly projecting pivot pin 62 which is received in a socket 64 formed in the base 34. The pin 62 may have an annular rib 66 formed on its outer surface and received in a similar annular groove 68 formed in the socket. Interengagement of this rib and groove prevent the latch from axially disengaging from the socket.

Figure 6:
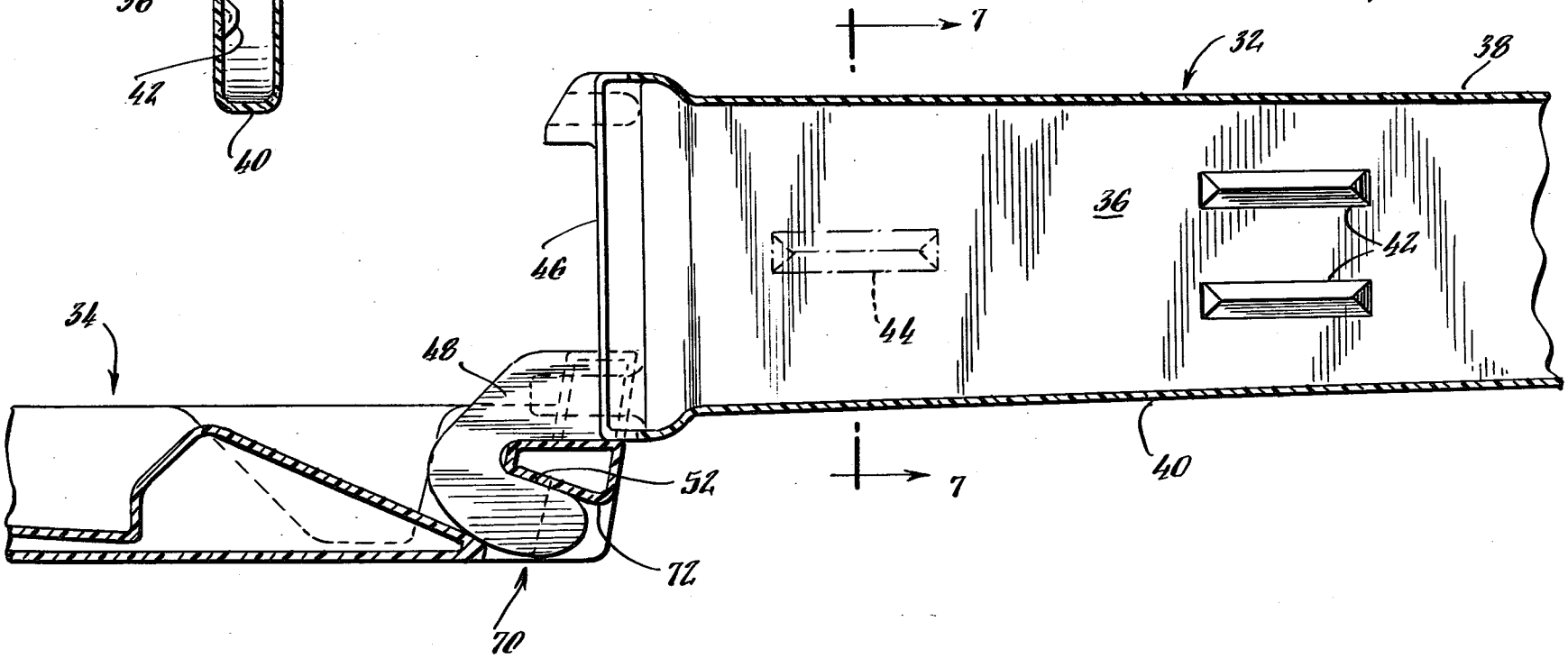
FIG. 6 is an enlarged vertical cross-sectional view taken through discontinuous plane 6—6 in FIG. 2.
Figure 7:
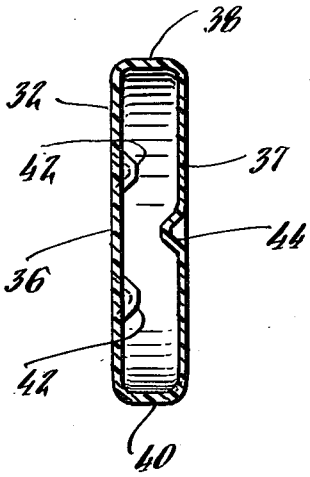
FIG. 7 is a vertical cross-sectional view taken through plane 7—7 in FIG. 6.

As can be seen in greater detail in FIG. 6, the forward portion of the base is formed with an eyelet 70 that extends at a forwardly downwardly sloping angle. The upper inner wall 72 of the eyelet constitutes a supported surface. The hook 48 formed on the scabbard 32 and the eyelet 70 formed in the base cooperate as a first linking means between the scabbard and the base. More particularly, the scabbard is mountable on the blade of the chain saw in a fixed position. Further, as shown in FIGS. 3 and 6, the hook may be received in or engaged within the eyelet by leftward movement, that is sideward movement relative to the one side of the chain saw from which the blade projects, with the scabbard mounted on it. When the hook is fully received in the eyelet, the support surface 52 confronts and supports the supported surface 72. The hook may be disengaged from the eyelet by opposite rightward sideward movement of the saw and scabbard.

Further, when the scabbard hook 48 is received in the eyelet 70, and the bottom of the chain saw housing is nested in the recess formed in the base, the latch may be pivoted to embrace an upper surface of a lower leg 74 of the handle 30 (FIG. 1). Accordingly, the latch constitutes a second linking means for linking the base to the chain saw and particularly to the handle 30 of the chain saw. The forwardly, downwardly sloping angle of the eyelet and complementary angle of the scabbard hook permit the saw to be tilted upwardly out of the recess in the base or downwardly into it to position the saw for establishing the second link by the latch to the rear saw handle.

When the scabbard is mounted in fixed position on the blade and the scabbard and base eyelet are engaged to establish the first link, and when the bottom of the chain saw housing is received in the recess of the base and the latch is pivoted to its latch position to embrace the lower handle leg 74 and concurrently establish the second link, the two component chain saw tote is lifted when the chain saw is lifted. That is, the blade is lifted with the chain saw housing to consequently lift the scabbard. Simultaneously, the base is also lifted by interaction of the scabbard and chain saw housing, through the first and second links, with it. Thus, the base and scabbard and anything they may carry are carried with the saw. It will be appreciated from the description above that the tote device of the present invention requires substantially less material to manufacture than a case which would enclose the entire saw. Further, however, the blade and the saw teeth carried on the chain guided by it are enclosed and protected against moisture and dust and are further shielded from an operator or other person who would handle the chain saw for storage or transport. Special handle arrangements on the tote device need not be provided for it since the handle on the saw provides a convenient means by which the saw and tote may be lifted.

It will further be appreciated that the formation of the base with the recess defined by the contoured walls 56 and bottom wall 58 limits the sideward movement of the saw once received in the recess. That is, abuttment of portions of the chain saw housing with portions of the contoured walls 56 bounding the recess in the base limit movement of the chain saw in a sideward leftward direction of FIGS. 2, 3 and 7. The interengagement of the latch 58 with the lower handle leg 74, also limits such sideward movement of the housing by constraining the bottom of the housing to be received in the recess 54. Therefore, when the second link is established between the handle 30 and the base by the latch, sideward leftward movement such as would disengage the hook from the eyelet is prevented.

The base and scabbard each have a relatively low profile. The base may be formed with nesting portions so that one base may be stacked upon another for storage and shipment. For example, as can be seen in FIGS. 3 and 4, the socket 64 formed in the base to receive the pivot pin 62 of the latch 58 may form a portion of an elongated groove 76. This groove may have sufficient depth and width to accommodate the upstanding portion of the latch of another base. Accordingly, this base configuration provides substantial savings in storage and shipment costs because the base requires substantially less space that do prior art cases for completely enclosing a tool. Similarly, the scabbard is of relatively thin profile and may easily be stacked with other scabbards for storage and shipment.

Both components of the chain saw tote device of the present invention are desirably made from conventional blow molding techniques. Because the components of the tote device are substantially smaller than those of conventional cases for fully enclosing tools, then may be made with such techniques with substantially shorter mold cycling times. Therefore, more tote devices in accordance with the invention may be produced per unit time than may be produced of conventional cases.

Figure 5:
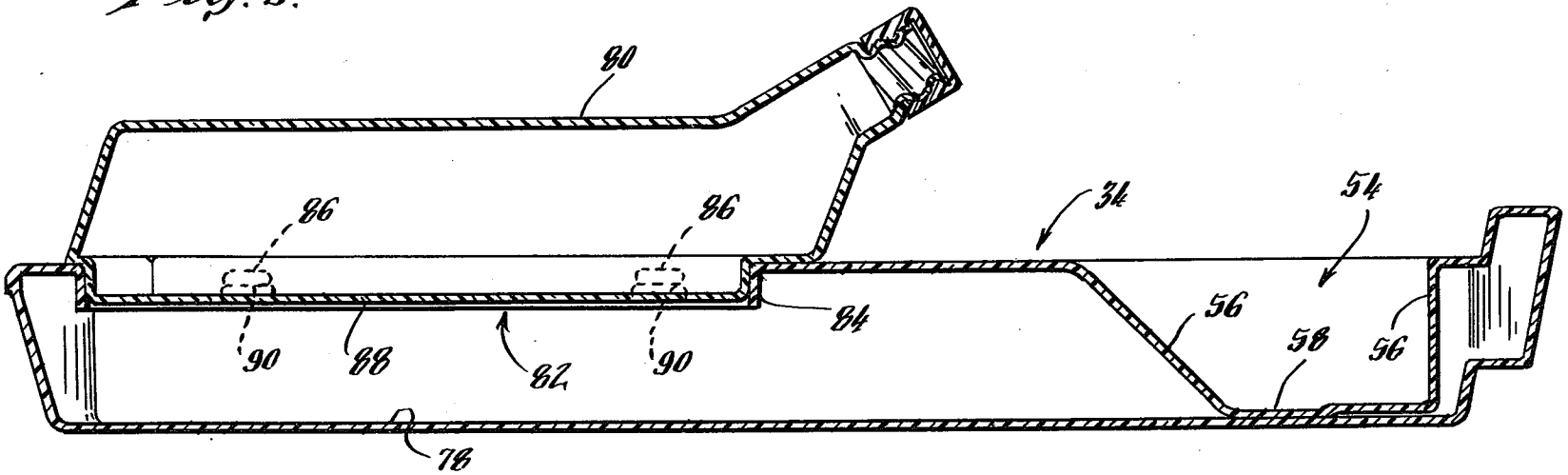
FIG. 5 is a vertical cross-sectional view taken through discontinuous plane 5—5 in FIG. 2.

As shown in FIGS. 4 and 5, when made with conventional blow molding techniques, the base of the tote device of the invention has a double wall construction. In the preferred embodiment, this construction is taken advantage of to provide a hollow storage compartment 78 to one side and rearwardly of the recess which receives the bottom of the chain saw housing. This compartment may be used to store accessories for the saw such as tools for adjusting chain tension or for making other repairs or adjustments.

In further accordance with the present invention, a bottle 80 is also mounted with the base and may be used to carry a liquid such as lubricant along with the saw when taken to a job site with the tote device. More particularly, as can be seen in FIGS. 4 and 5, the base is formed with an enlarged generally trapazoidal opening 82 to the compartment that is bounded by a depending peripheral wall 84. Portions of this peripheral wall are formed with inwardly projecting ribs 86. The bottle 80 may be formed with a depending portion 88 having a cross-sectional shape substantially congruent to the opening 82 to the compartment. Further, this depending section of the bottle may also be formed with peripheral beads 90 which are vertically spaced from an outwardly projecting downwardly facing flange 92 formed at the upper margin of the depending section 88 of the bottle. The beads 90 are positioned to snap beneath the inwardly projecting ribs 90 of the depending wall 84 bounding the opening to the compartment. Further, the flange 92 is positioned to seat against upwardly facing portions 93 of the base bounding the opening when the depending portion of the bottle is so snapped into the opening.

Accordingly, it will be appreciated that the bottle may be snapped into and out of the opening to the compartment and the base and thereby act as a cover for the compartment to confine tools and other accessories in it.

Figure 9:
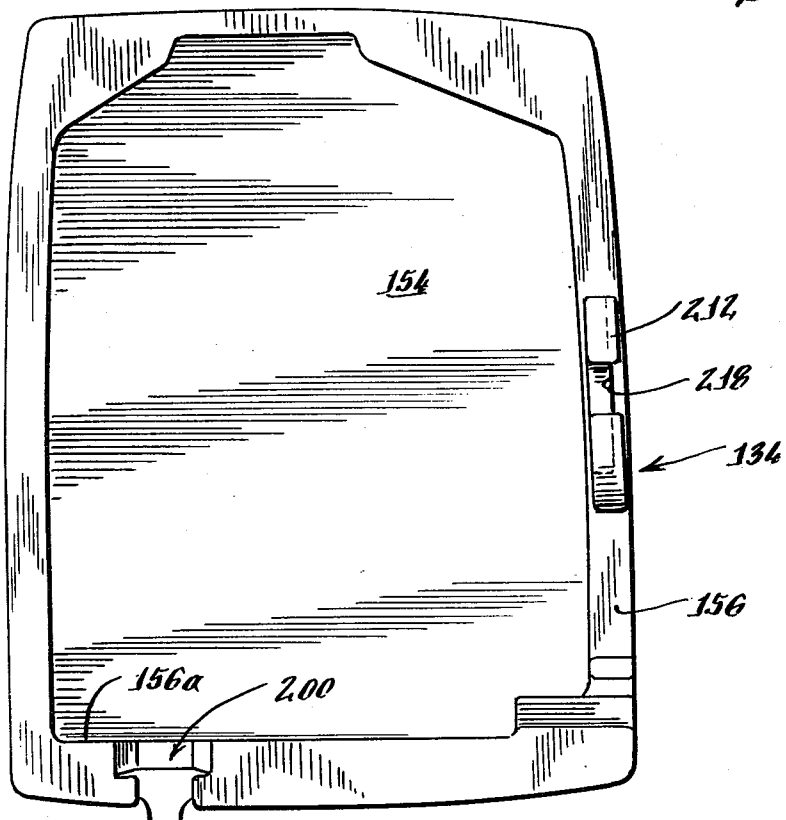
FIG. 9 is a top plan view of the base of this embodiment of the invention.
Figure 8:
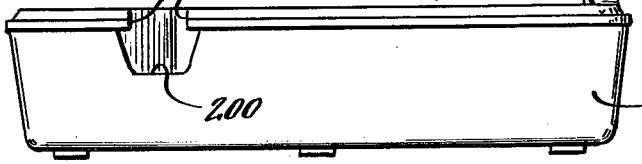
FIG. 8 is a front elevational view of the base of a second embodiment of the tote device of the present invention.

A second embodiment of the present invention is shown in FIGS. 8 through 13. This embodiment differs from the first embodiment in the specific means for linking the scabbard to the base and for linking the chain saw housing to the base. More particularly, as can be seen in FIGS. 8 and 9 a forward wall **156*a* of the base 134 is formed with a downwardly open slot 200. A pair of studs or lugs 202** project horizontally into the slot at its upper margin. The ends of the studs are spaced by a finite distance.

Figure 12:
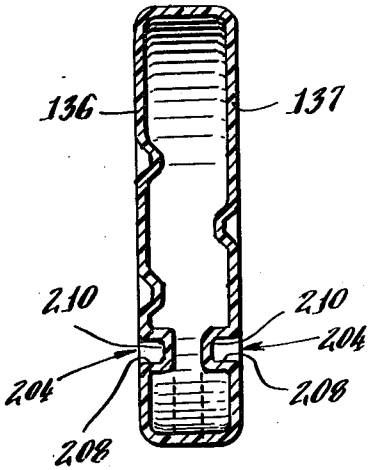
FIG. 12 is a vertical cross-sectional view of the scabbard shown in FIG. 11 taken on plane 12—12 there.
Figure 11:
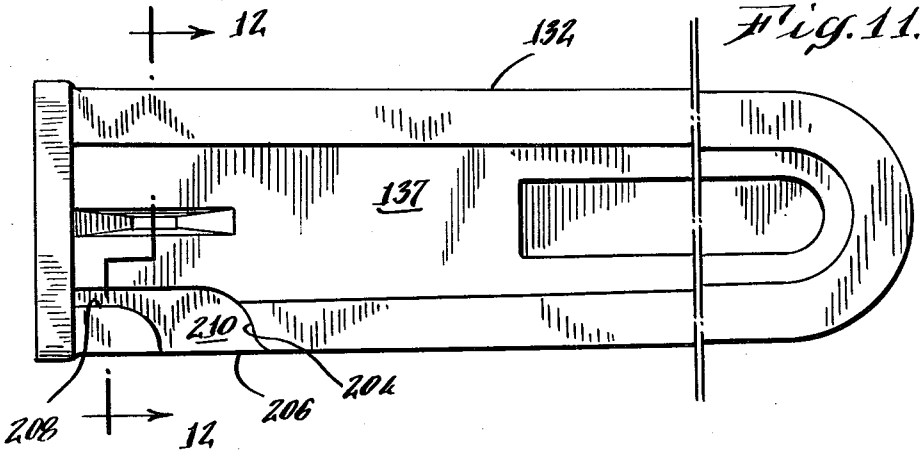
FIG. 11 is a side elevational view of the scabbard of this second embodiment.

The scabbard 132, shown in FIGS. 11 and 12, rather than being formed with a depending hook as was the scabbard of the first embodiment, is instead formed with a generally J-shaped groove 204 adjacent the lower margin of each of its side walls 136 and 137. Each groove has a downwardly open mouth 206 the horizontal extent of which is at least as large as the width of each stud 202. Further, the groove defines an upwardly facing lower support surface 208 and a base partition 210. The base partitions 210 of the grooves formed in opposing side walls 136 and 137 of the scabbard are spaced by a distance greater than the space between the ends of the inwardly projecting studs 202. Accordingly, as can be seen in the figures, the scabbard may be linked to the base by sliding the scabbard downwardly and sidewardly onto the slot 200 with the studs 202 received in the grooves 204 of the scabbard until the studs may be supported on the lower groove surfaces 208. Accordingly, when the scabbard is lifted, engagement of the studs with the support surfaces 208 of the grooves causes the base to simultaneously be lifted.

Figure 10:
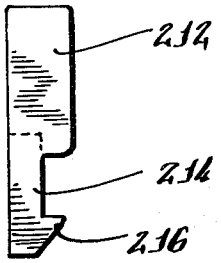
FIG. 10 is a front elevational view of a latch member which is mounted with the base in the second embodiment of the invention.
Figure 13:
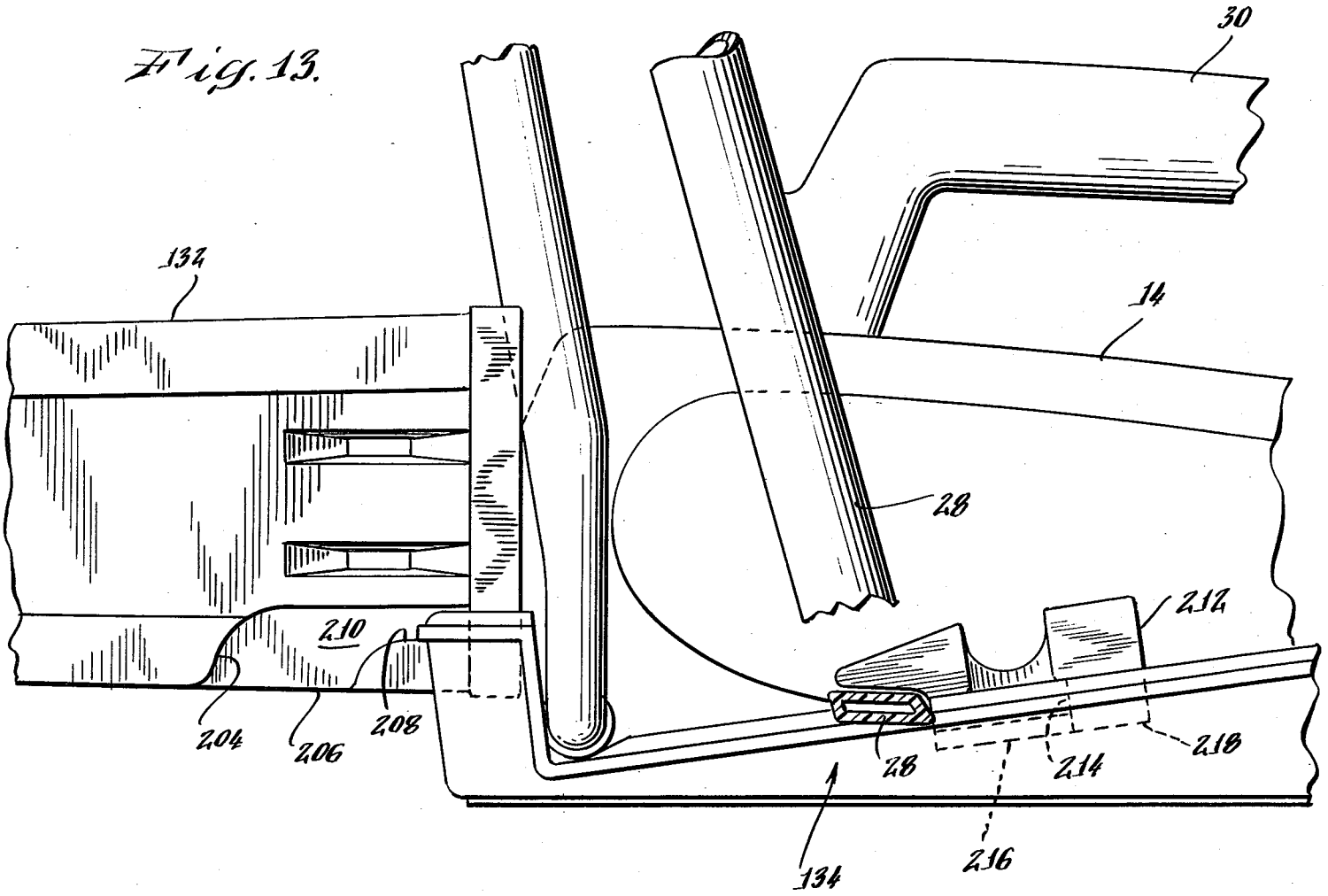
FIG. 13 is a partial side elevational view of the second embodiment of the tote device of the invention shown with a chain saw supported in it.

The second linking arrangement is provided by a slidable latch 212 shown in FIGS. 9, 10 and 13, having a depending tab 214 formed with a sidewardly projecting retaining bar 216. The tab is received in a similar slot 218 formed in an upwardly facing surface of a side wall **156*b* of the base of the latch. Therefore, the latch may be slid forwardly and backwardly in the slot. The slot 218 has greater longitudinal extent than does the tab 214. A forward projecting arm 220 of the latch 212 is designed to engage and embrace an upper surface 222 of one of the forward handles 226 attached to the chain saw housing (FIG. 13**).

Again, the saw is mounted in the tote device by linking the scabbard, when mounted on the blade, to the base and by linking the saw housing to the base. The recess 154 in the base and the forward wall **156*a* together with the latch 212** cooperate to prevent unlinking sideward movement of the scabbard from the base.

The grooves 204 in the scabbard and the studs 202 formed on the base 134 are further dimensioned and shaped to permit the saw and scabbard to be tilted relative to the base so that the scabbard and saw may be positioned on and removed from the base with the respective first and second links established.

From the above description of the present invention it can be seen that various arrangements for linking the scabbard to the base and for linking the chain saw housing to the base may be provided. The positioning of these respective linking arrangments may vary depending upon the specific configuration of the saw or other tool to be carried. It is, however, important that one link be remote from the other to provide sufficient support for the base when the saw and the scabbard mounted on it are lifted.

Accordingly, it will be appreciated that the preferred embodiments of the present invention have been described in detail. Modifications may be made to these described structures in order to adapt the tote device of the present invention to particular applications.

What is claimed is:

1. A tote device for an article including a main body and a member projecting from one side of said body; said tote device comprising:

means for supporting said body when at rest including a base formed with an upwardly open recess configured to receive at least a portion of said body;

scabbard means mountable on said member to enclose and protect a portion thereof;

first means for linking said scabbard means, when mounted on said member, to said base in the region of said one side of said body; and second means for linking said base to said body when said portion of said body is received in said recess, at a location remote from said one side;

whereby upward movement of said body and said member results in upward movement of said scabbard means and, by interaction of said scabbard means and said body with said base through said first and second linking means, of said base.

2. A tote device according to claim 1, wherein said base is formed with an eyelet and has a downwardly facing supported surface adjacent said eyelet, and wherein said first linking means comprises a hook attached to said scabbard means and having an upwardly facing support surface, said hook being shaped and positioned on said scabbard means to be received and engaged in said eyelet with said support surface seated against said supported surface when said scabbard means is mounted on said member.

3. A tote device according to claim 2, wherein said scabbard means is mountable in fixed position on said member, wherein said hook and said eyelet are formed to be engaged by relative movement therebetween in one generally horizontal sideward direction and to be disengaged by relative movement therebetween in an opposite generally horizontal sideward direction, and wherein said second link means further limits sideward movement of said body and said member and, hence, said scabbard means in said opposite direction.

4. A tote device according to claim 1 wherein said recess in said base defines a generally upstanding wall having a downwardly open slot therein, said wall being formed with a pair of opposing studs, having spaced ends, projecting generally horizontally into said slot; and wherein said scabbard means includes a pair of side walls spaced to be closely adjacent said blade when mounted thereon, each said side wall being formed with an outwardly open, generally horizontally extending groove defining a lower support surface and generally parallel base partitions spaced by a distance greater than the space between said stud ends; each of said studs being slidably receivable in one of said grooves when said scabbard means is mounted on said blade and said housing is received in said recess, whereby said lower support surfaces engage said studs to support said base when said article and, hence said member, are lifted, said studs and said lower support surfaces thereby constituting said first linking means.

5. A tote device according to claim 1, 2 or 3 wherein said scabbard means is mountable in fixed position on said blade, wherein said first linking means is arranged to link said scabbard means and said base by relative movement therebetween in one generally horizontal sideward direction and to unlink them by relative movement therebetween in an opposite generally horizontal sideward direction, and wherein said second linking means and engagement of said portion of said body with portions of said base further limit sideward movement of said body and said member and, hence, said scabbard means in said opposite direction and thereby prevent unlinking movement of said scabbard means and said base.

6. A tote device for a chainsaw including a main housing, power supplying means mounted in said housing, a handle projecting laterally from one side of said housing, a blade projecting laterally from a different side of said housing and a chain carrying saw teeth guided about at least a portion of the periphery of said blade and driven by said power supplying means; said tote device comprising:

a base for supporting said housing when at rest, formed with an upwardly open recess configured to receive at least a portion of said housing and said handle;

a scabbard mountable on said blade to enclose and protect at least a portion of said blade and said chain;

first means for linking said scabbard, when mounted on said blade, to said base in the region of said different side of said housing; and second means for linking said base to said handle, whereby said blade supports said scabbard and whereby said base is supported by said scabbard and said handle, through said first and second linking means, when said chainsaw is lifted.

7. A tote device according to claim 6 wherein said base is formed with an eyelet and has a downwardly facing supported surface adjacent said eyelet, and wherein said first linking means comprises a hook, having an upwardly facing support surface, shaped and attached to said scabbard at a position to be received and engaged in said eyelet when said scabbard is mounted on said blade with said supported surface seated against said support surface.

8. A tote device according to claim 6 wherein said recess in said base defines a generally upstanding wall having a downwardly opening slot therein said wall being formed with a pair of opposing studs, having spaced ends, projecting generally horizontally into said slot; and wherein said scabbard includes a pair of side walls spaced to be closely adjacent said blade when mounted thereon, each said side wall being formed with an outwardly open generally horizontally extending groove defining a lower support surface and generally parallel base partitions spaced by a distance greater than the space between said stud ends; each of said studs being slidably receivable in one of said grooves when said scabbard is mounted on said blade and said housing is received in said recess, whereby said lower support surfaces engage said studs to support said base when said chain saw and, hence said blade, is lifted, said studs and said lower support surfaces thereby constituting said first linking means.

9. A tote device according to claim 6, 7 or 8 wherein said scabbard is mountable in fixed position on said blade, wherein said first linking means is arranged to link said scabbard and said base by relative movement therebetween in one generally horizontal sideward direction and to unlink them by relative movement therebetween in an opposite generally horizontal sideward direction, and wherein said second linking means and engagement of said portions of said body with portions of said base further limit sideward movement of said body and said member and, hence, said scabbard in said opposite direction and thereby prevent unlinking movement of said scabbard from said base.

10. A tote device according to claim 6, 7 or 8, said second linking means comprising latch means mounted on said base for movement between a latched position embracing a portion of said handle when said housing and handle are received in said recess and an unlatched position disengaged from said handle.

11. A tote device according to claim 9, said latch means comprising a latch mounted for pivoted movement between said latched and unlatched positions about a vertically extending axis and having an arm engageable over an upper surface of said handle to confine said handle with said recess when in the latched position.

12. A tote device according to claim 6, wherein said recess in said base forms an oil drip pan for said saw.

13. A tote device according to claim 6, wherein said base defines a hollow storage compartment, and an opening to said compartment.

14. A tote device according to claim 13, further comprising a bottle for storing a liquid, formed to snap into and cover said opening and thereby serve as a cover for said compartment.

* * * * *